US006492771B2

(12) United States Patent
Cho et al.

(10) Patent No.: US 6,492,771 B2
(45) Date of Patent: Dec. 10, 2002

(54) BULB AND A METHOD FOR WELDING A PIPE AND A CONDUCTIVE WIRE THEREOF

(75) Inventors: Hirosumi Cho, Yokohama (JP); Kenji Sakai, Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 123 days.

(21) Appl. No.: 09/765,406

(22) Filed: Jan. 22, 2001

(65) Prior Publication Data

US 2001/0028219 A1 Oct. 11, 2001

(30) Foreign Application Priority Data

Jan. 31, 2000 (JP) ..... 2000-023129
Aug. 31, 2000 (JP) ..... 2000-264436

(51) Int. Cl.[7] ..... H01J 17/18
(52) U.S. Cl. ..... 313/623; 313/573; 313/583
(58) Field of Search ..... 313/573, 583, 313/623, 626, 634

*Primary Examiner*—Vip Patel
(74) *Attorney, Agent, or Firm*—Pillsbury Winthrop LLP

(57) ABSTRACT

A bulb comprises an airtight envelope having a filling gas therein. A conductive wire extends outwardly from the airtight envelope. A conductive pipe pin has the conductive wire passed therethrough, a predetermined welding portion, and a welded portion including a smooth surface. An outer diameter of the welded portion is no greater than the outer diameter of the pin. The welded portion may be formed in the pipe pin by the fluid of the melted conductive wire and predetermined welding portion flowing into the pipe pin and hardening.

19 Claims, 7 Drawing Sheets

BULB AND A METHOD FOR WELDING A PIPE AND A CONDUCTIVE WIRE THEREOF

BACKGROUND OF THE INVENTION

1. Field of Invention

The present invention relates to a bulb having a pipe pin and a conductive wire, and a method for welding the pipe pin and the conductive wire thereof.

2. General Background and Related Art

A method for connecting a conductive wire to a pipe pin of a fluorescent lamp is disclosed in Japanese Laid Open Patent Application SHO 60-39786. Namely, the conductive wire is passed through the pipe pin. A projecting portion of the wire from a tip of the pin is cut off, leaving a predetermined length of wire projecting through the pipe pin. The predetermined portion is pushed back to the tip of the pipe pin. The pin with the conductive wire is punched at one side thereof together.

Using this method does not always result in a rigid joining of the wire and the pin. Accordingly, to better assure good joining by this method, it is necessary to use, in conjunction with the method a punching level detecting device measuring an extent of press. Such a device is described in Japanese Laid Open Patent Application SHO 61-51728. Occasionally, after being punched, the tip of the wire projects from the tip of the pipe pin. The projecting portion sometimes accidentally injures a user, such as, for example, when the lamp is being changed.

Another method for arc-welding a pipe pin and a conductive wire is described in Japanese Laid Open Patent Application SHO 60-20427. The disclosed method somewhat simplifies the processes, and prevents the tip of the wire from projecting from the tip of the pin. This method utilizes a forming process to bend the projecting tip of the wire toward one side of the pin. Though the bending portion is still welded with the pipe pin, the tip of the bending portion occasionally appears on the welding region. Accordingly, the welded pin can not be inserted in a socket. Moreover, as the bending portion is primarily welded, both the bending wire and pin can not be sufficiently connected. Furthermore, if the pin includes zinc, the zinc evaporates due to the heat of welding. Accordingly, zinc vapor sticks to an outer surface of the pin, so that the pin becomes unclean.

SUMMARY

One aspect of the claimed inventions is directed to an improved arrangement for connecting a conductive wire and a pipe pin of a bulb construction. Another aspect of the claimed inventions focuses on an improved method of welding a pipe pin and a conductive wire which provides a simpler way of welding and a more effective resulting weld.

Another aspect of the claimed invention is directed to the bulb construction itself. The bulb comprises an airtight envelope having a filling gas therein. A conductive wire extends outwardly from the airtight envelope. This conductive wire is passed through a conductive pipe pin. A predetermined welding portion of the wire extends from the bottom of the pipe pin. A weld at this welding portion produces a smooth surface. An outer diameter of the welded portion, which is formed from melting a portion of both the predetermined welding portion and the conductive wire, is no greater than the outer diameter of the pin.

Still another aspect of the claimed invention is directed to the bulb construction itself. The bulb comprises an airtight envelope having a filling gas therein. A conductive wire extends outwardly from the airtight envelope. A conductive pipe pin has the conductive wire passed therethrough, a predetermined welding portion, and a welded portion including a smooth surface. The welded portion is formed in the pipe pin by the fluid of the melted conductive wire and predetermined welding portion flowing into the pipe pin and hardening.

Some of the claimed inventions feature a method for welding a pipe pin and a conductive wire of a bulb. The method is generally described as follows:

- outwardly extending the conductive wire from an airtight envelope having a bulb base;
- arranging the pin including the predetermined welding portion, to the bulb base, the pin having an outer diameter that is less than that of a pin base;
- passing the conductive wire through the pipe pin with a tip of the conductive wire projecting from tip of the pin;
- cutting off the tip of the conductive wire, leaving a predetermined length; and
- welding the pin and the conductive wire in order to form a welded portion having a smooth surface at the tip portion of the pin.

These and other aspects of the invention will be further described in the following drawings and detailed description of the invention.

BRIEF DESCRIPTION OF THE DRAWINGS

In the following, the invention will be described in more detail by way of examples illustrated by drawings in which.

DETAILED DESCRIPTION

An exemplary embodiment of the invention will be described in detail with reference to FIGS. 1 to 8.

Figure 1:
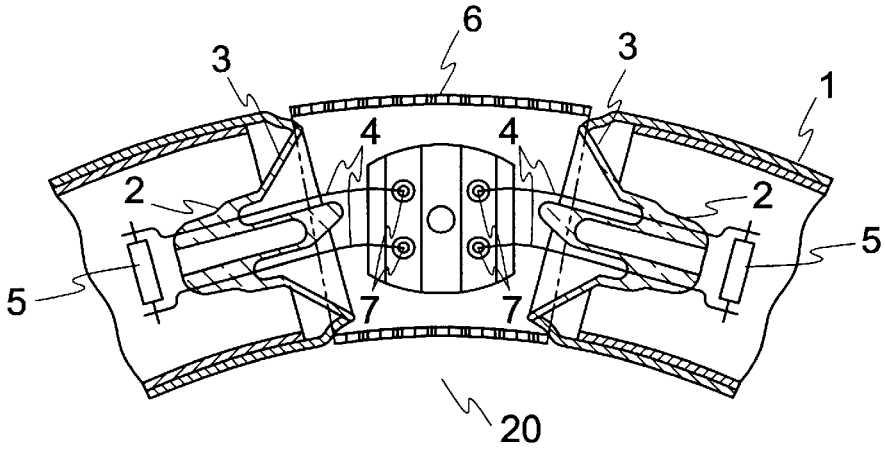
FIG. 1 is an enlarged longitudinal section of a part of a fluorescent lamp according to first embodiment of the present invention.

FIG. 1 shows an enlarged longitudinal section of a part of a fluorescent lamp 20 according to first embodiment of the present invention. The fluorescent lamp 20 has a bulb, which in this embodiment is a circular arc tube 1. A pair of stems 2 air-tightly seal the two ends of the arc tube. Bulb base 6 is made of plastic and has four conductive pipe pins 7. Bulb base 6 could be constructed from other suitable materials. Each of conductive pipe pins 7 has a respective predetermined welding portion 8 and a holding portion fixed on bulb base 6 arranged between the two ends of the arc tube. The predetermined welding portion 8 of a pipe pin 7 is easily melted and is punched in order to make good contact with wire 4.

Pin 7 has an outer diameter of 2.3 mm and a thickness of 0.8 mm at its holding portion side. At the predetermined welding portion side, pin 7 has a 1.7 mm in diameter and a 0.5 mm thickness. Of course these dimensions apply only to this example. Other shapes and sizes can be used. The shapes and sizes of all parts can be selected so as to be appropriate for a given size and shape of lamp.

The bulb including an electrode may be an incandescent lamp, a discharge lamp such as a fluorescent lamp, an electrodeless discharge lamp or a high intensity discharge lamp, or an electron tube. The arc tube may be made of a light-transmitting glass or ceramics. The arc tube may be made into any suitable shape desired, such as a linear, circular, or U-shape.

Each of the stems 2 has a pair of conductive wires 4, 4. One end of each conductive wire is connected to a filament 5 as the electrode via inner wires. The other end of each conductive wire 4 extends from the arc tube 1. The conductive wires 4 are respectively inserted into pipe pins 7. The inner diameter of the pipe pin 7 is preferably 25% to 60% of its outer diameter at portion 8 of the pin. Also, the inner diameter of pipe pin 7 is preferably within 120% to 280% of the outer diameter of conductive wire 4, in order to provide for a rigid connection. Tips of the conductive wires 4 extend from one end via the pins 7. The tip of each conductive wires is cut off, and the tip and one end of its respective pin are welded together using a welding device. The conductive wire may comprise three parts, which are made of respective different materials, including an outer part extending from the arc tube, a part embedded in the seal, and an inner part existing in the arc tube.

Figure 2:
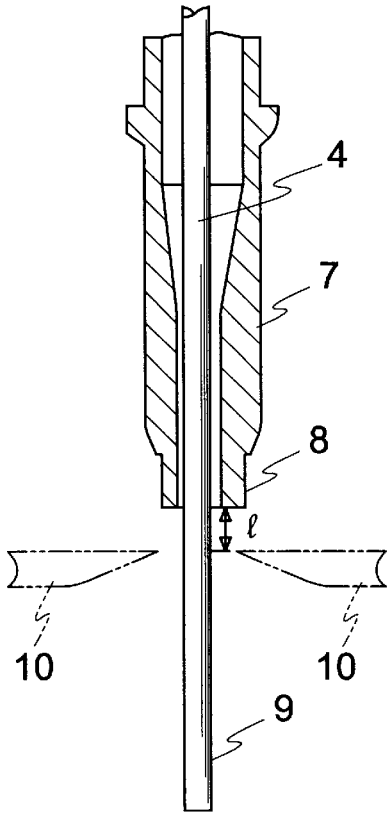
FIG. 2 is an enlarged longitudinal section of a conductive pin passed through a conductive wire of the lamp shown in FIG. 1.

FIG. 2 shows an enlarged longitudinal section of the conductive pin with an inserted conductive wire of the lamp. A method for manufacturing the lamp includes the following: 1) sealing the arc tube, 2) exhausting the arc tube, 3) electrode flushing, and 4) lamp base assembly. During the lamp base assembly process, a cutting device 10 cuts off a wire-projecting portion 9 extending from the conductive pin 7. As a result, the wire-projecting portion 9 remains a predetermined length (l) as shown in FIG. 2.

Figure 6:
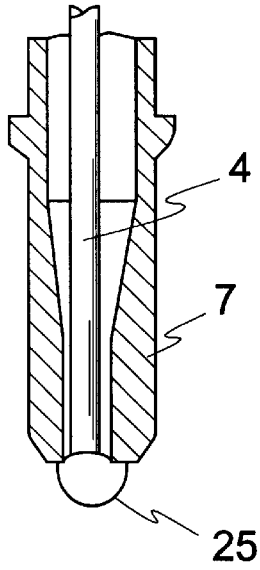
FIG. 6 is an enlarged longitudinal section of a welded conductive pin of the lamp shown in FIG. 1.

A welded portion 25 shown in FIG. 6 is formed by a welding device, which can melt the remaining length (l) and the predetermined welding portion 8 of the pin, together. An outer diameter of the welded portion 25 may be the outer diameter of the pin 7 or less, and larger than the inner diameter of the pipe pin. Accordingly, the welded portion can be easily inserted into a socket (not shown) and cannot go back into the pipe pin 7. Furthermore, the volume of the remained length (l) can control the size of the welded portion 25.

A surface of the welded portion can be formed smoothly, by using a plasma welding device. Of course, other types of welding devices can be used and perhaps other suitable techniques will be developed in the future. Plasma welding, which is one kind of arc welding, can be used effectively because it is possible to increase current density ($A/mm^2$) of a plasma arc by contracting the diameter of the arc. Accordingly, the plasma-welding device can melt a metal having a high melting point by 1 to 3 million degrees centigrade of a temperature of the plasma arc center.

Figure 3:
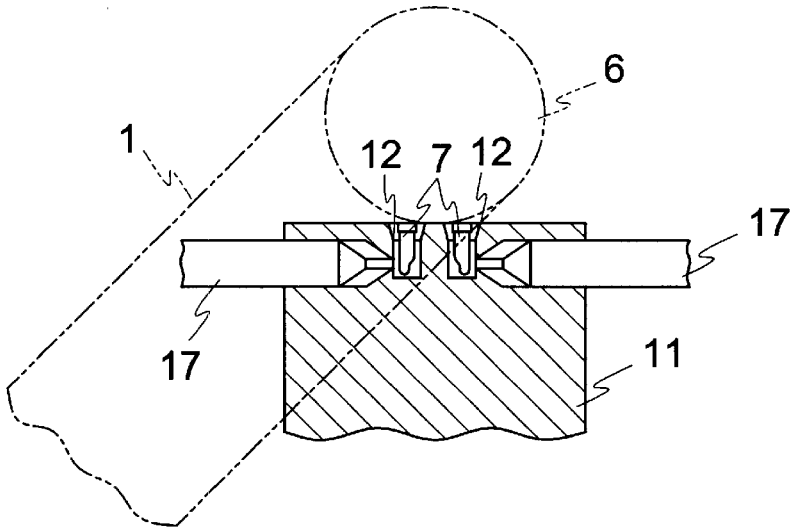
FIG. 3 is a sectional view of a punching device setting up the conductive pins passed through the conductive wires of the lamp shown in FIG. 1.
Figure 4:
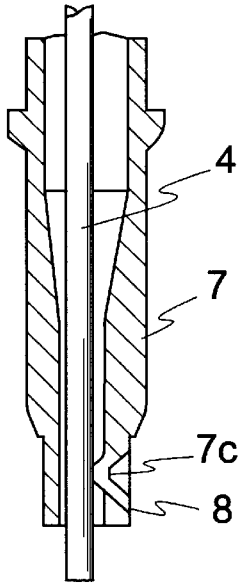
FIG. 4 is an enlarged longitudinal section of a punched conductive pin of the lamp shown in FIG. 1.

A punching device shown in FIG. 3 loads the lamp having the conductive pipe pins 7 including the wire-projecting portion 9 in length (l). The punching device includes a lamp holding device (not shown), a guide block 11 having four guide holes 12 therein and punching members 17. The holding device supports the circular arc tube 1 with the pins 7 facing downward. After the pins are located, the guide block moves in the direction of the circular arc tube 1, so as to insert the pins 7 into the guide holes 12. After the holes 12 accommodate pins 7, guide block 11 stops moving, with an upper surface of the block contracting the bulb base 6. Next, the punching members 17 respectively move to in the direction of the pins 7, and press the predetermined welding portion of the pins 7, in order to make a dent 7*c*. Accordingly, the conductive wire 4 and the pipe pin 7 join temporary at the dent 7*c* as shown in FIG. 4, and can also conduct a current easily.

The welding process of the pipe pins and the conductive wires will be explained hereinafter.

Figure 5:
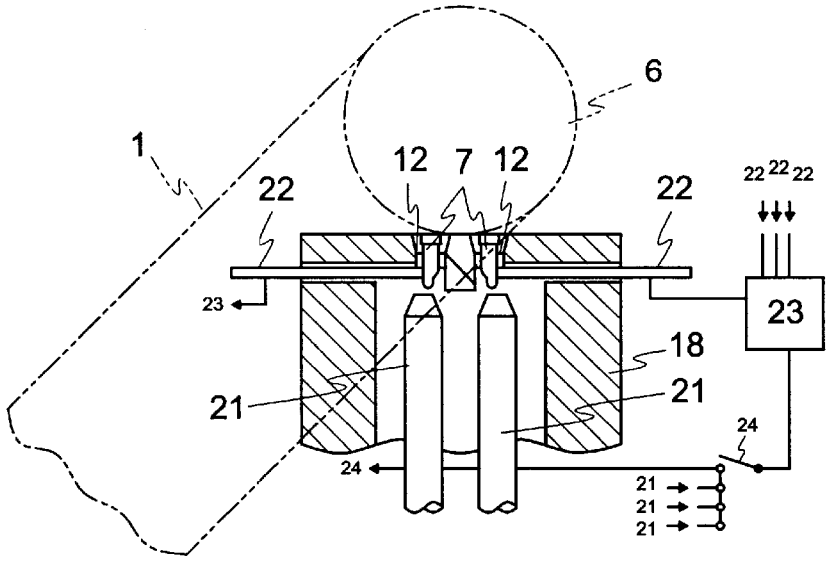
FIG. 5 is a partial section of a welding device holding the punched conductive pin of the lamp shown in FIG. 1.

FIG. 5 shows a partial section of the welding device holding the punched conductive pin 7 of the lamp 20. After unloading guide block 11 from the circular arc tube 1, another welding guide block 18 moves to in the direction of the circular arc tube 1, so as to insert pines 7 into respective guide holes 12. The welding block 18 has four welding torches 21 respectively arranged in opposition to the predetermined welding portion 8 of the pins 7, and four welding electrodes 22 enabling to contact the side face of the pins 7 by moving in the direction of the pins 7. Electrodes 22 are electrically connected to a power supply via a switching arrangement 24. After the plasma-welding torches 21 rises adjacent to the predetermined welding portion 8 of the pins 7 except contacting, the switching arrangement 24 switches to apply power to the electrodes. Accordingly, a plasma arc generates between the welding torch 21 and the predetermined welding portion 8 of the pin 7. The predetermined welding portions 8 and the conductive wires 4 are melted by heat of the plasma arc, so that the welded portions 25 are formed as shown in FIG. 6. The outer diameter of the welded portions 25 are respectively less than that of the outer diameter of the pins 7. A length of the welded portions 25 is about 2 mm from the tip of the pin 7. Furthermore, the welded portions 25 are formed approximately spherical shape having smoothly surface. The spherical shape may be formed by means of a surface tension of the melted materials during the welding, or of a metal finishing such as a abrasive method after the welding. Accordingly, the welded portions 25 of the pins 7 prevent user from injuring, when user changes the lamp for example.

Figure 7:
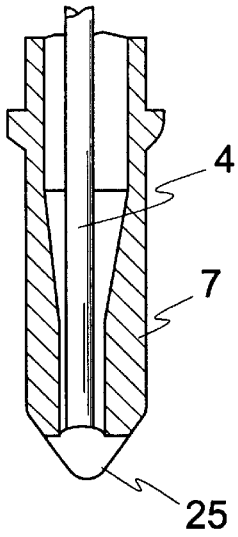
FIG. 7 is an enlarged longitudinal section of a welded conductive pin of a fluorescent lamp, according to another aspect of the embodiment of the present invention.
Figure 8:
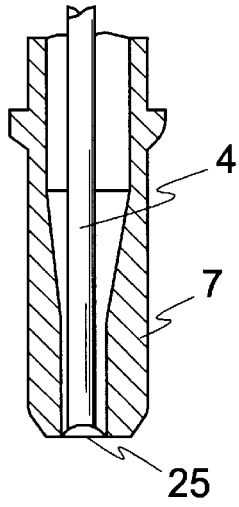
FIG. 8 is an enlarged longitudinal section of a welded conductive pin of a fluorescent lamp, according to another aspect of the embodiment of the present invention.

Furthermore, the surface of the welded portion 25 may curve continuously from an outer surface of the tip of the pin 7 as shown in FIG. 7. In this case, the shape of the welded portion 25 is formed by means of changing a welding condition, such as increasing a welding time, or raising output current of the power supply. Furthermore, the surface of the welded portion 25 may be flattened at the tip of the pin as shown in FIG. 8.

A second exemplary embodiment of the invention will be explained in detail with reference to FIGS. 9 to 13. Similar reference characters designate identical or corresponding to the elements of above-mentioned first embodiment. Therefore, detail explanations of the structure will not be provided.

Figure 9:
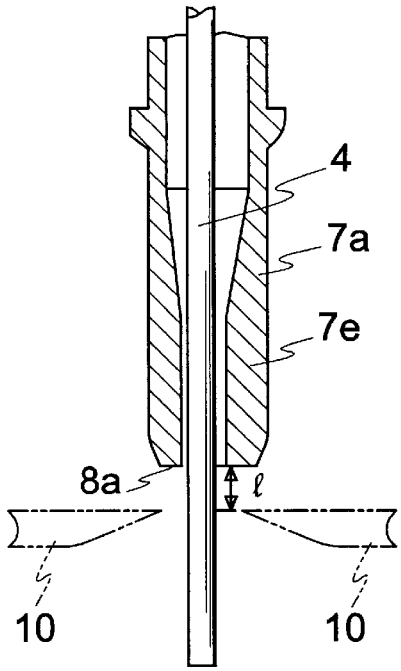
FIG. 9 is an enlarged longitudinal section of a conductive pin passed through a conductive wire of a fluorescent lamp, according to second embodiment of the present invention.
Figure 10:
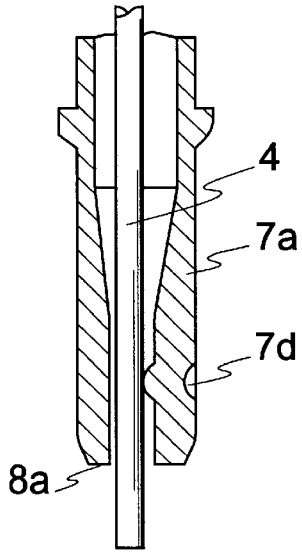
FIG. 10 is an enlarged longitudinal section of a punched conductive pin of the lamp shown in FIG. 9.

In this embodiment, before the inserted conductive wire 4 extending from the pipe pin 7*a* including zinc is cut off, a punching member may press the predetermined pressing portion 7*e* of the pin, in order to make a dent 7*d*, as shown in FIGS. 9 and 10. In this case, the conductive pipe pin 7*a* has 2.3 mm in outer diameter and 0.8 mm in thickness at the predetermined pressing portion 7*e*. Moreover, the dent 7*d* completely contacts the conductive wire 4 in order to maintain conducting a current.

Furthermore, the predetermined pressing portion 7*e* of 0.8 mm in thickness can be used as the predetermined welding portion. The predetermined pressing portion 7*e* can produce a large amount of melted metal, so that the melted metal of the pipe pin 7*a* can be sufficiently connected to the conductive wire 4.

Figure 11:
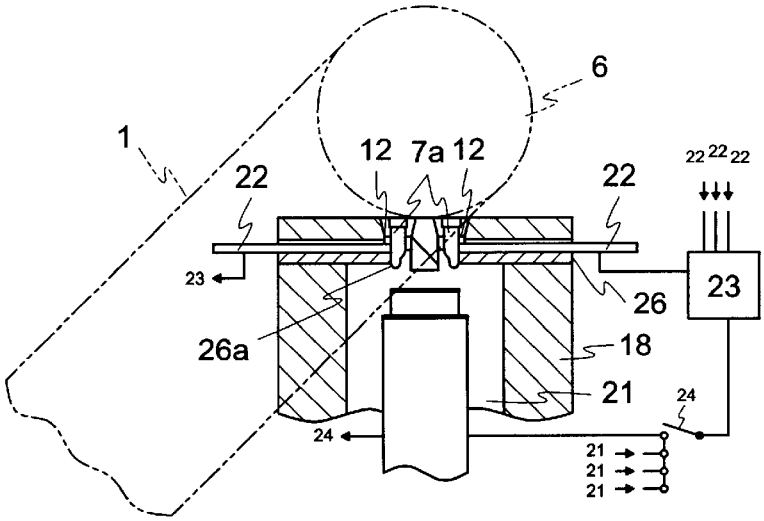
FIG. 11 is a partial section of a welding device holding the punched conductive pin of the lamp shown in FIG. 10.
Figure 12:
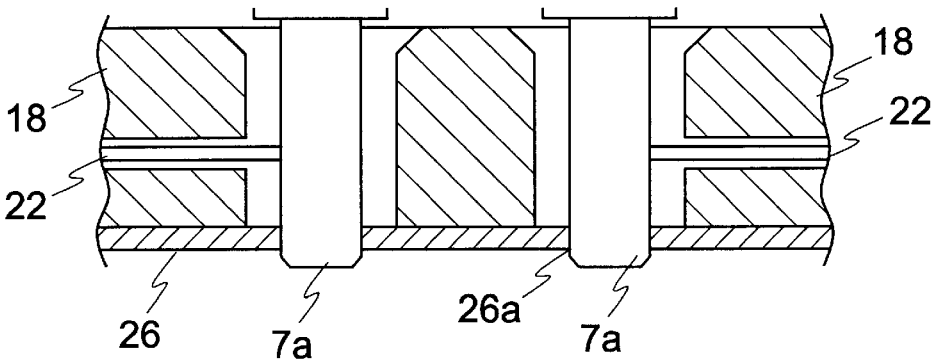
FIG. 12 is an enlarged partial section of a welding device holding the punched conductive pin of the lamp shown in FIG. 1.

FIG. 11 shows a partial section of a welding device holding the punched conductive pin of the lamp according to the second embodiment. FIG. 12 shows an enlarged partial section of the welding device holding the punched conductive pipe pin of the lamp according to the second embodiment. In this embodiment, after unloaded the circular arc tube 1 from the guide block 11, another welding guide block 18 moves in the direction of the circular arc tube 1, so as to insert the pines 7 into the guide holes 12. The welding block 18 has a welding torch 21, four welding electrodes 22, and a high heat conductive cover element 26. The welding torch 21 is arranged in opposition to the pipe pin 7*a*. The four welding electrodes 22 can contact the side faces of the pins 7*a* by means of moving in the direction of the pipe pins 7*a*.

The high heat conductive cover element 26 made of copper defines through holes 26*a*. A diameter of the holes 26*a* may be adjacent to the outer diameter of the pipe pins 7*a*. Accordingly, since the pins 7*a* can pass through the through holes 26*a* of the cover element 26, a projecting length of the pins 7*a* from the cover element 26 can change by changing the thickness of the cover element 26. Cover element 26 can prevent a heat of the plasma arc from conducting to the bulb base 6. Therefore, the bulb base 6 does not deform easily. Furthermore, the cover element 26 can prevent zinc included the pin vapor from sticking to the outer surface of the pins 7*a*. When the projecting length of the tip portion from the cover element 26 is over 2 mm, the vapor of zinc tends to stick to the outer surface of the pins 7*a*.

Figure 13:
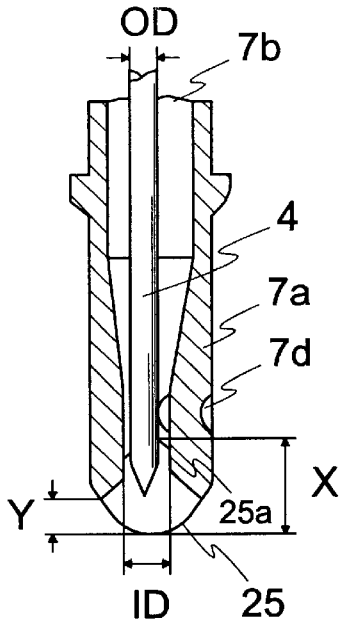
FIG. 13 is an enlarged longitudinal section of a welded conductive pin of the lamp shown in FIG. 11.

Electrodes 22 are connected to a power supply via switching means 24. After the plasma-welding torch 21 moves adjacent to tips 8*a* of the pins 7*a* except contacting, the switching arrangement 24 is switched to apply power. Accordingly, a plasma arc generates between the welding torch 21 and the tip 8*a* the pin 7*a*. Therefore, the tip 8*a* and the conductive wire 4 are melted by a heat of the plasma arc, so that the welded portion 25 are formed as shown in FIG. 13. After one welded portion 25 was formed, the plasma-welding torch 21 moves to in the direction of another pin 7*a*, one by one, in order to form the welded portion.

FIG. 13 shows an enlarged longitudinal section of the welded conductive pin of the lamp. The outer diameter of the welded portion 25 is larger than an inner diameter of the pipe pin 7*a*, is still an outer diameter or less. Moreover, an outer surface of the welded portion 25 is formed continuously from an outer surface of the tip of the pin 7*a*. Furthermore, when the conductive wire 4 is melted by the plasma arc, a fluid of the melted wire 4 and predetermined welding portion of the pipe pin 7*a* flows into the pipe 7*b* of the pin 7*a*, and hardens into a part of the welded portion 25. Namely, the fluid can also join the conductive wire 4 and pipe pin 7*a* in the pipe 7*b*. Moreover, as the fluid flows into the pipe 7*b*, the welded portion 25 of the pipe pin 7*a* tends to become smaller in comparison with the outer diameter of the pipe pin 7*a*. In this case, an outer diameter (OD) of the conductive wire is 0.5 mm. The inner diameter (ID) of the pipe 7*b* is 0.9 mm. A length (X) of the welded portion 25 is 0.9 mm. The distance (Y) from a tip of the welded portion to a tip of the pin 7*a* is 0.3 mm. Accordingly, the welded portion 25 can increase a welded region of between the pin 7*a* and the conductive wire 4, and volume thereof also becomes large. Therefore, the welded portion 25 can prevent the pin and the conductive wire from separating.

A third exemplary embodiment of the invention will be explained in detail with reference to FIGS. 14 and 15. Similar reference characters designate identical or corresponding to the elements of above-mentioned first embodiment. Therefore, detail explanations of the structure will not be provided.

Figure 14:
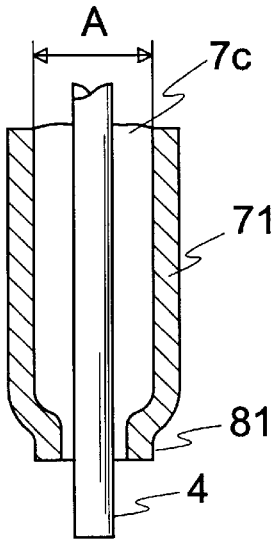
FIG. 14 is an enlarged longitudinal section of a conductive pin inserting a conductive wire of a fluorescent lamp, according to third embodiment of the present invention.
Figure 15:
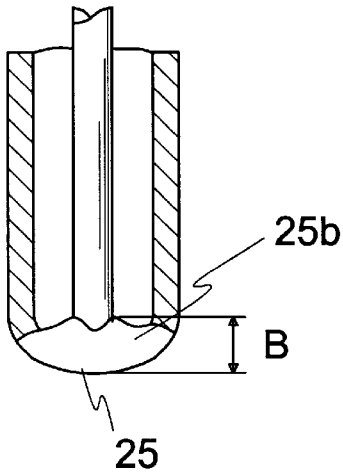
FIG. 15 is an enlarged longitudinal section of a welded conductive pin of the lamp shown in FIG. 14.

FIG. 14 shows an enlarged longitudinal section of a conductive pin inserting a conductive wire of a fluorescent lamp. FIG. 15 shows an enlarged longitudinal section of a welded conductive pin of the lamp.

In this embodiment, the inserted conductive wire 4 extends from the pipe pin 71. When the conductive wire 4 is melted by the plasma arc, a fluid of the melted wire and the predetermined welding portion of the pin 71 flows into the pipe pin 71, and hardens into a part 25*b* of the welded portion 25. In this case, a length (B) of the welded portion is 0.5 mm. The length of welded portion projecting from a tip of the pin 71 prefers a range of 1 mm to 2 mm, so as to join rigidly both the conductive wire 4 and pipe pin 71. The conductive pin 71 has 2.3 mm in outer diameter and 0.3 mm in thickness at one end of the pin 71. The conductive pin 71 also has unitary a predetermined welding portion 81, which is 1.3 mm in outer diameter, and 0.3 mm in thickness, at the other end of the pin 71. The welded portion 25 has an outer diameter being less than the inner diameter A of the pin 71. An outer surface of the welded portion 25 is formed continuously from an outer surface of the tip of the pin 71. According to this embodiment, the thickness of the pin 71 is thinner than that of above-mentioned pins 7,7*a*, so that the output of the power supply and the welding time can be drop effectively.

What is claimed is:

1. A bulb comprising:

an airtight envelope having a filling gas therein;

a conductive wire extending outwardly from the airtight envelope; and a conductive pipe pin having the conductive wire passed therethrough, a predetermined welding portion, and a welded portion including a smooth surface; wherein, an outer diameter of the welded portion, which is formed from a melting portion both the predetermined welding portion and the conductive wire, is no greater than the outer diameter of the pin.

2. A bulb according to claim 1, wherein, the welded portion has a surface formed continuously from an outer surface of a tip of the pin.

3. A bulb according to claim 2, wherein, the surface of the welded portion curves.

4. A bulb according to claim 1, wherein, the welded portion has an approximately spherical shape.

5. A bulb according to claim 1, wherein, the welded portion is formed by means of a plasma welding method.

6. A bulb according to claim 1, wherein, the welded portion projects from a tip of the pipe pin, and a length of the projected portion is a range of 0.5 mm to 3 mm.

7. A bulb according to claim 1, wherein, the welded portion existing in the pipe pin has 0.5 mm or more in length from the tip of the pin.

8. A bulb according to claim 1, wherein, a thickness of a tip portion of the pin is thicker than that of a pin base of the pin, and the tip portion has 1 mm or more in length.

9. A bulb according to claim 1, wherein a thickness of a tip portion of the pin is 0.7 mm or more.

10. A bulb according to claim 8, wherein the pipe pin further comprises a pressed portion on the tip portion.

11. A bulb according to claim 9, wherein the pipe pin further comprises a pressed portion on the tip portion.

12. A bulb according to claim 1, wherein the conductive wire material disappears in the welded portion.

13. A bulb comprising:

an airtight envelope having a filling gas therein;

a conductive wire extending outwardly from the airtight envelope; and a conductive pipe pin having the conductive wire passed therethrough, a predetermined welding portion, and a welded portion including a smooth surface; wherein, the welded portion is formed in the pipe pin by the fluid of the melted conductive wire and predetermined welding portion flowing into the pipe pin and hardening.

14. A method for welding a pipe pin and a conductive wire of a bulb, comprising:

outwardly extending the conductive wire from an airtight envelope having a bulb base;

arranging the pipe pin including predetermined welding portion, of which outer diameter is less than that of a pin base, to the bulb base;

passing the conductive wire through the pipe pin with a tip of the conductive wire projecting from tip of the pipe pin;

cutting off the tip of the conductive wire into predetermined length; and welding the pipe pin and the conductive wire in order to form a welded portion having a smooth surface at the tip portion of the pipe pin.

15. A method according to claim 14, wherein a thickness of the tip portion of the pin is equal to or thicker than that of the pin base.

16. A method according to claim 14, further comprising:

pressing a predetermined welding portion of the pipe pin in order to fix the conductive wire and pin temporarily by means of a punching member.

17. A method according to claim 14, further comprising:

covering the pin except the tip portion with a cover element in order to weld the tip.

18. A method according to claim 17, wherein the cover element has high heat conductivity.

19. A method according to claim 17, wherein a projecting length of the tip portion from the cover element is 2 mm or less.

* * * * *